US006202464B1

(12) United States Patent
Hatanaka et al.

(10) Patent No.: US 6,202,464 B1
(45) Date of Patent: Mar. 20, 2001

(54) UNIVERSAL ROLLING MILL

(75) Inventors: Atsushi Hatanaka; Hironori Miura, both of Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/582,525

(22) PCT Filed: Dec. 3, 1999

(86) PCT No.: PCT/JP99/06796

§ 371 Date: Jul. 21, 2000

§ 102(e) Date: Jul. 21, 2000

(87) PCT Pub. No.: WO00/33985

PCT Pub. Date: Jun. 15, 2000

(30) Foreign Application Priority Data

Dec. 10, 1998 (JP) ..... 10-351696

(51) Int. Cl.[7] ..... B21B 13/10; B21B 31/08

(52) U.S. Cl. ..... 72/225; 72/239

(58) Field of Search ..... 72/224, 225, 226, 72/238, 239, 247

(56) References Cited

U.S. PATENT DOCUMENTS 4,958,509 * 9/1990 Kusaba et al. ..... 72/225
5,152,164 * 10/1992 Horiuchi et al. ..... 72/238
5,154,074 * 10/1992 Haraguchi et al. ..... 72/247
5,295,380 * 3/1994 Hioki et al. ..... 72/239

FOREIGN PATENT DOCUMENTS 7-102365 11/1995 (JP) .

* cited by examiner

*Primary Examiner*—Rodney A. Butler
(74) *Attorney, Agent, or Firm*—Oliff & Berridge, PLC

(57) ABSTRACT

The present invention provides a universal rolling mill in which rolls including width-variable rolling rolls can be replaced at a time even if the universal rolling mill is of a type in which a yoke is caused to recede upward. A concrete structure of the invention is the universal rolling mill including a pair of width-variable rolling rolls each of the rolls having a driving portion (housed in a support box) detachably joined to an end portion of a roll shaft on an operating side for varying a rolling width, the pair of width-variable rolling rolls being used as horizontal rolls, in which a receiving/passing device for receiving and passing the driving portion of an upper width-variable rolling roll from and to the rolling mill is mounted to a yoke for receiving reaction force of an upright roll on the operating side.

2 Claims, 7 Drawing Sheets

UNIVERSAL ROLLING MILL

TECHNICAL FIELD

The present invention relates to a universal rolling mill used in manufacturing section steel such as H-shapes. In particular, the invention relates to a universal rolling mill having width-variable rolling rolls. The width-variable rolling roll has a horizontal roll body divided into two parts and a gap between both the parts is changed to vary a rolling width.

BACKGROUND ART

In rolling a section steel, and especially the H-shapes, the universal rolling mill in which a pair of upper and lower horizontal rolls and a pair of right and left vertical rolls are incorporated into the same stand is used in general.

FIG. 1 shows rolling of an H-shapes. An H-shapes 1 is rolled by using vertical rolls (upright rolls) 7, 7' and horizontal rolls 45, 45'. A flange width 101 of the H-shapes 1 can be varied freely in a range of a roll body length 106 of the vertical rolls 7, 7'. On the other hand, a web height 102 (*h*) is determined by $h=W+2t_1$, where $t_1$ is a flange thickness 103 and W is a roll body length 104 of the horizontal rolls 45, 45'. Therefore, by a set of horizontal rolls with a constant width, only a size of the web height can be selected.

As the H-shapes, there is so-called H-shapes with constant outer dimensions that has a constant web height (web outer width) h. The H-shapes with the constant outer dimensions includes H-shapes with various flange thicknesses for the same nominal dimensions. For example, if the nominal dimensions are the web height: 600 mm×the flange width: 200 mm, the flange thickness is in a range of 12 to 28 mm. Therefore, it is necessary to properly vary a rolling width 105 ($W_1$) according to the flange thickness. To adapt to change in the rolling width of the rolls, it is necessary to frequently replace the rolls. By frequently replacing the rolls, productivity is degraded. A large number of man-hours are necessary for the replacement and it is necessary to possess a large number of rolls.

To solve the above problems, there are width-variable rolling rolls proposed in Japanese Patent Publication No. 7-102365. A sectional view of an essential portion of the upper width-variable rolling roll is shown in FIG. 2. A roll body 10 is divided into a driving-side roll body 10*a* and an operating-side roll body 10*b*. The driving-side roll body 10*a* and the operating-side roll body 10*b* move relatively to each other along a direction of roll shafts and can move closer to and away from each other. Through a hollow strong portion of an operating-side roll shaft 11*b* to which the operating-side roll body 10*b* is fixed, a driving-side roll shaft 11*a* to which the driving-side roll body 10*a* is fixed is inserted and fitted. One of both the roll shafts can be inserted into and withdrawn from the other in the roll shaft direction and both the roll shafts can rotate synchronously. The driving-side roll shaft 11*a* and the operating-side roll shaft 11*b* are supported respectively by a driving-side roll chock 3 and an operating-side roll chock 4 functioning as bearings. An operating-side slide block 19 rotation of which is restrained and which can slide only in the direction of the roll shafts is mounted through a thrust bearing 17 to an operating-side shaft end of the operating-side roll shaft 11*b*. On the other hand, a push-in shaft 20 is disposed to be adjacent to a driving-side shaft end of the operating-side roll shaft 11*b* and a driving-side slide block 24 is mounted through a thrust bearing 21 to the push-in shaft 20. A screw block 25 for synchronous rotation is fastened to the driving-side slide block 24. To the screw block 25, a screw 27 with a pitch $P_1$ and a screw 28 with a pitch $2P_1$ which have the same thread direction as each other are provided. The screw 27 is screwed to a fixed screw block (fixed screw ring 26) rotation and movement of which are restrained. The screw 28 is screwed to the above operating-side slide block 19.

Torque is transmitted from the driving-side roll shaft 11*a* to the operating-side roll shaft 11*b* through a feather key 16, for example.

A claw ring 30 is fitted into a notch groove 29 at an end portion of the driving-side slide block 24. A speed reducer 31 and an electric motor 32 are connected to the claw ring 30. When the electric motor 32 operates, the screw block 25 rotates. Because the screw block 25 is screwed to the fixed screw ring 26, the screw block 25 moves in the roll shaft direction. Because the driving-side slide block 24 fastened to the screw block 25 and the push-in shaft 20 move synchronously, the driving-side roll shaft 11*a* can move toward a driving side in the roll shaft direction (in a direction shown by an arrow 110). However, because the push-in shaft 20 is in contact with the driving-side roll shaft 11*a* only through a spherical face 111, a push-in device is used separately to move the driving-side roll shaft 11*a* toward an operating side in the roll shaft direction (in a direction reverse to the direction of the arrow 110). On the other hand, the operating-side slide block 19 connected to the screw block 25 through the screw 28 cannot rotate and can slide only in the roll shaft direction. Therefore, the slide block 19 moves in the shaft direction in a reverse direction to movement of the screw block 25 due to rotation of the screw block 25. For example, when the screw block 25 moves toward the driving side by a distance corresponding to a pitch $P_1$ of the screw 27, the operating-side slide block 19 moves toward the operating side by a distance corresponding to a pitch $2P_1$ of the screw 28, which results in movement of the operating-side roll body 10*b* by a distance corresponding to the pitch $P_1$ toward the operating side. In other words, with a turn of the screw block 25, the respective driving-side and operating-side roll bodies 10*a* and 10*b* move by distances corresponding to $P_1$ in the reverse directions to each other without changing centers of the rolls. Therefore, it is possible to freely change a rolling width 105 of the horizontal rolls without changing the roll centers.

Here, a seal 33 is a scale seal for preventing scales or water from entering a gap between the driving-side roll body 11*a* and the operating-side roll body 11*b*.

In other words, effects of the technique disclosed in Japanese Patent Publication No. 7-102365 are as follows.

a) A roll width can be varied on-line, by remote control, and arbitrarily.

b) Because the roll width can be varied such that the rolls are shifted rightward and leftward respectively by the same distance from the roll center, the technique can be easily applied to tandem mills.

c) Even if the rolls are worn, products with constant dimensions can be obtained by varying the width.

d) Products with different sizes can be produced without replacing the rolls.

FIG. 3 is an explanatory view of an essential portion of a universal rolling mill having the above width-variable rolling rolls. A reference numeral 1 designates H-shapes as material to be rolled, 2, 2' designate a width-variable rolling rolls, 3, 3' designate driving-side roll chocks, 4, 4' designate operating-side roll chocks, 5, 5' designate spindle couplings for connecting horizontal rolls to a driving device, 6, 6' respectively designate downstroking and upstroking screws, 7, 7' designate upright rolls (vertical rolls), 8, 8' designate upright roll chocks, and 9, 9' designate support boxes.

The support box 9 (and 9', similarly) has a structure divided into a support box 9*a* bolted to the operating-side roll chock 4 and a support box 9*b* joined to the support box 9*a* as shown in FIG. 2. The above rolling width varying device is incorporated into the support box. In the support box 9*b*, a rolling width varying driving portion (hereafter simply referred to as "a driving portion") such as the push-in shaft 20, the speed reducer 31, the electric motor 32, and the like of the rolling width changing device is housed.

A support box 9*b* is joined to a support box 9*a* by using a lock device 400 shown in FIG. 4. The lock device 400 is formed from a lock pin 40, a lock bar 41, a spring 42, and a lock cylinder 43. By releasing the lock device 400, the support boxes 9*a* and 9*b* are easily separated from each other at a joint face. Therefore, the rolling width changing device can be easily separated from and mounted to a roll main body.

In order to separate the driving portion in the support box 9*b* from the roll shaft, the electric motor 32 in FIG. 2 is operated to move the push-in shaft 20 and the screw block 25 in the direction reverse to the direction of the arrow. By this movement, the push-in shaft 20 moves away from the roll shaft end with which the push-in shaft 20 was in contact only through the spherical face 111 and screwing for connecting the screw block 25 to a member in the support box 9*a* by the screws 27 and 28 is released. As a result, the driving portion is separated from the roll shaft. To connect the driving portion to the roll shaft, the above operations may be carried out in reverse order.

As described above, the technique disclosed in Japanese Patent Publication No. 7-102365 also has the following effects.

e) Because the roll and the rolling width varying device can be separated from and mounted to each other in a short time, the number of width adjusting devices may be decreased as compared with the number of the rolls.

However, depending on a type of the universal rolling mill, the following problems occur in replacement of the rolls.

FIG. 5 shows a front view of a universal rolling mill in which horizontal rolls have a constant width. A reference numeral 2' designates the horizontal roll with the constant width and others are similar to those in FIG. 3.

In general, the universal rolling mill receives rolling reaction force of the upright rolls 7, 7'. Therefore, rolling is carried out while pressing the upright roll chocks 8, 8' from outside by using reaction force receiving members called yokes 50. In replacement of the rolls, on the other hand, the yoke 50 on the operating side is caused to recede to keep working space. In this case, it is preferable to withdraw a roll set including the horizontal rolls 2, 2' and the upright rolls 7, 7' from the housing into the working space at a time and then to mount a new roll set for shortening the time required for replacement.

FIG. 6 shows a front view of a universal rolling mill in which the horizontal rolls have a variable width. A reference numeral 2 designates a horizontal roll with the variable width and others are similar to those in FIG. 3.

When the universal rolling mill is of a type in which the yoke 50 is caused to recede in a horizontal direction (rightward in FIG. 6 or in a direction perpendicular to a paper face), there is no problem. However, in the universal rolling mill of a type in which the yoke 50 is caused to recede upward, the yoke 50 interferes with the above support box 9 and therefore, the yoke 50 cannot recede. As a result, the roll set cannot be replaced at a time and the replacement of the rolls is time-consuming to extremely degrade efficiency.

On the other hand, in recent years, to improve accuracy of dimensions of the H-shapes or for systematic control, there is a tendency to dispose a plurality of universal rolling mills close to each other. For effectively utilizing a building, a place to put the products in is adjacent to the rolling mills in some cases. Therefore, it is difficult to keep space in the front and rear and on the right and left sides in the rolling direction of the universal rolling mill.

SUMMARY OF THE INVENTION

Therefore, it is an object of the present invention to provide a universal rolling mill of a type in which a yoke is caused to recede upward, having rolls including width-variable rolling rolls which can be replaced in a short time, and having high productivity.

A summary of the invention to achieve the above object is as follows.

(1) A universal rolling mill including width-variable rolling rolls each having a driving portion detachably joined to an end portion of a roll shaft on an operating side for varying a rolling width, the width-variable rolling rolls being used as horizontal rolls, wherein a receiving/passing device for receiving and passing the driving portion of an upper width-variable rolling roll from and to the rolling mill is mounted to a yoke for receiving reaction force of an upright roll on the operating side.

(2) A universal rolling mill according to (1), wherein the receiving/passing device has a guide for guiding a support box for housing the driving portion of the upper width-variable roll and a cylinder for drawing and pushing the support box into and out of the guide.

THE BEST MODE TO CARRY OUT THE INVENTION

In the present invention, a receiving/passing device for receiving and passing a driving portion from and to a rolling mill is mounted to a yoke that receives reaction force of an upright roll on an operating side, the driving portion being detached from an upper width-variable rolling roll and for changing a width. By using the receiving/passing device, a driving portion of an upper roll can be lifted together with the yoke in causing the yoke to recede upward. As a result, working space for replacing the rolls can be easily kept on an operating side of the rolling mill.

Figure 1:
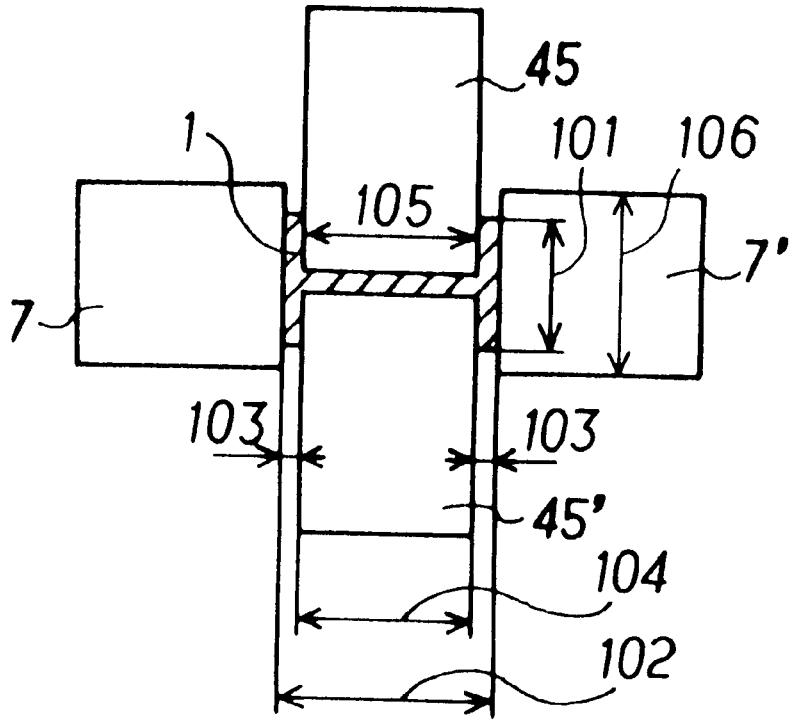
FIG. 1 is a front view showing rolling of H-shapes.
Figure 2:
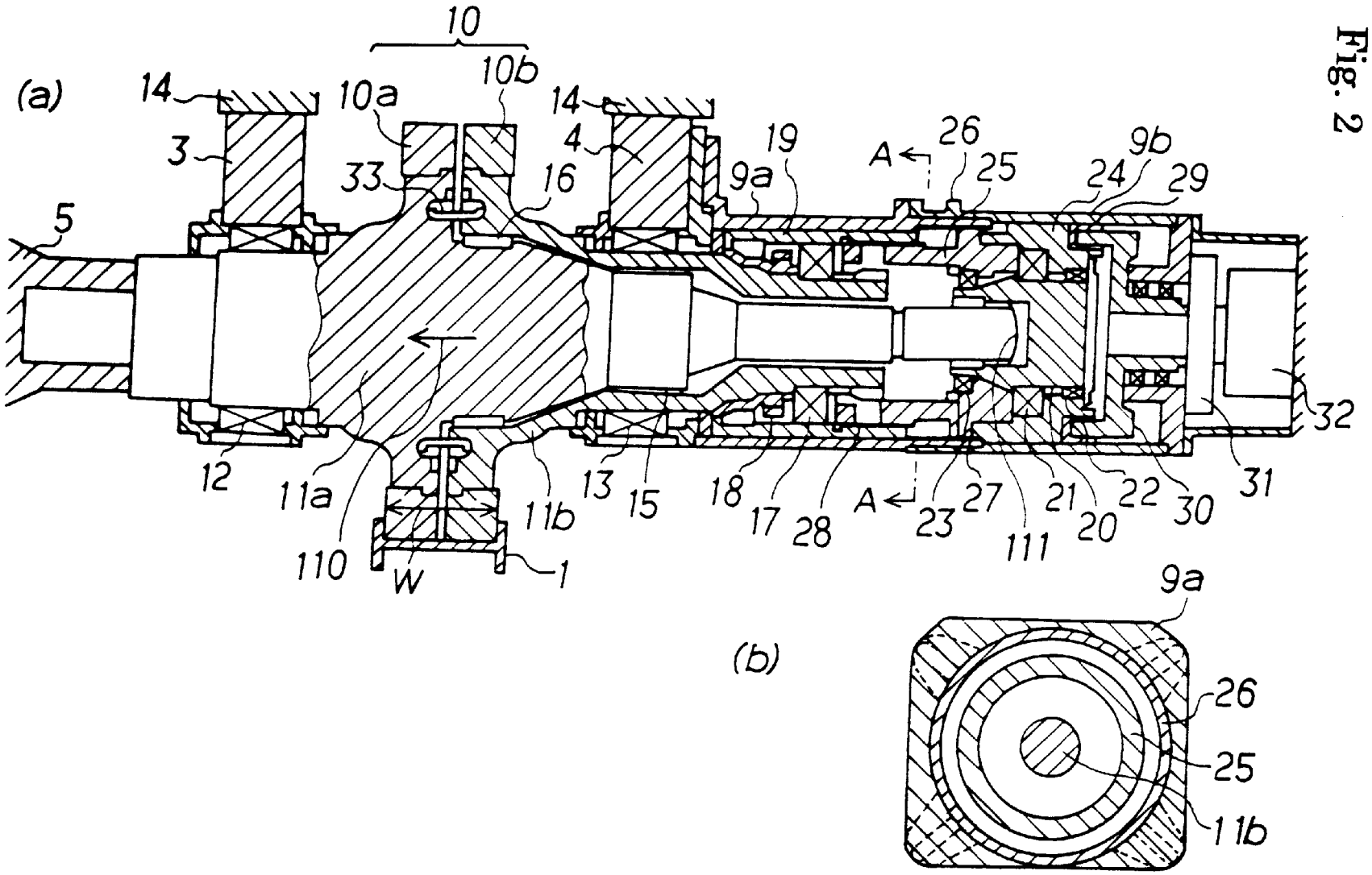
FIG. 2(*a*) is a front sectional view of an essential portion of an upper width-variable roll and FIG. 2(*b*) is a sectional view taken in an axial direction.
Figure 3:
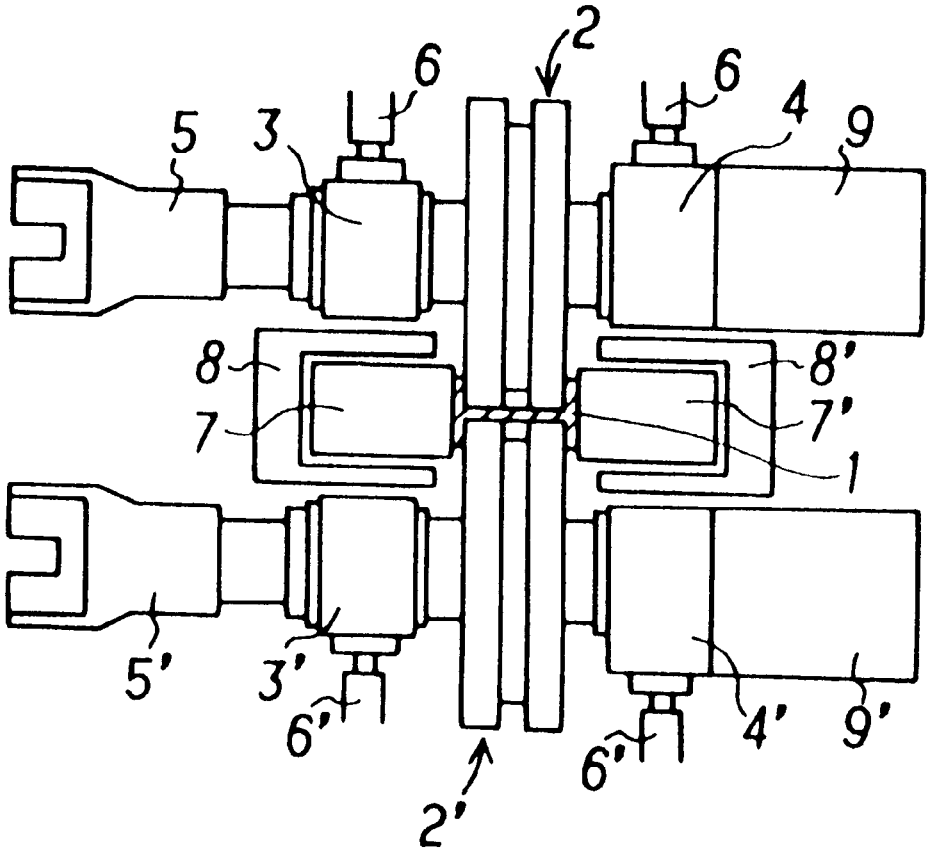
FIG. 3 is a front view of an essential portion of a universal rolling mill having width-variable rolling rolls.
Figure 4:
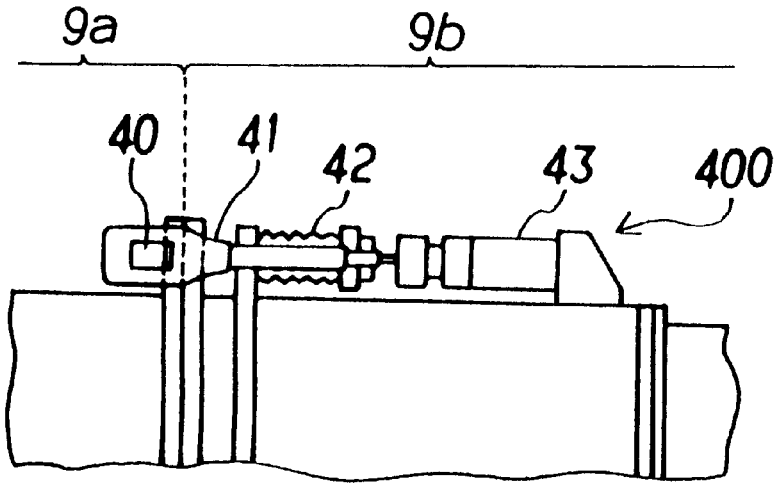
FIG. 4 shows an essential portion of a lock device of a support box.
Figure 5:
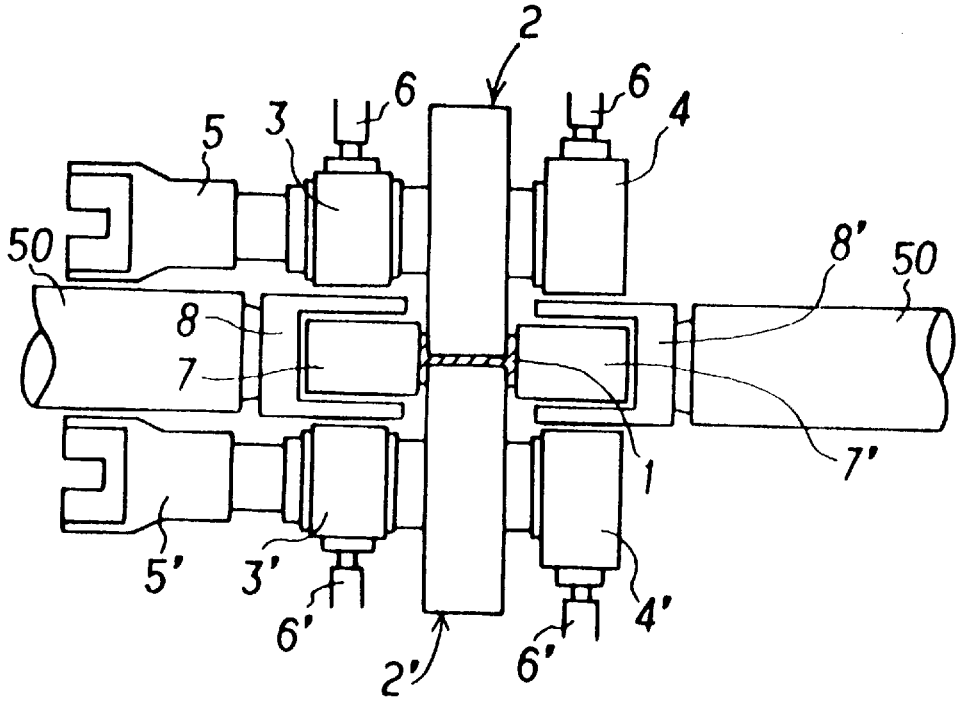
FIG. 5 is a front view of an essential portion of a universal rolling mill in which horizontal rolls have a constant width.
Figure 6:
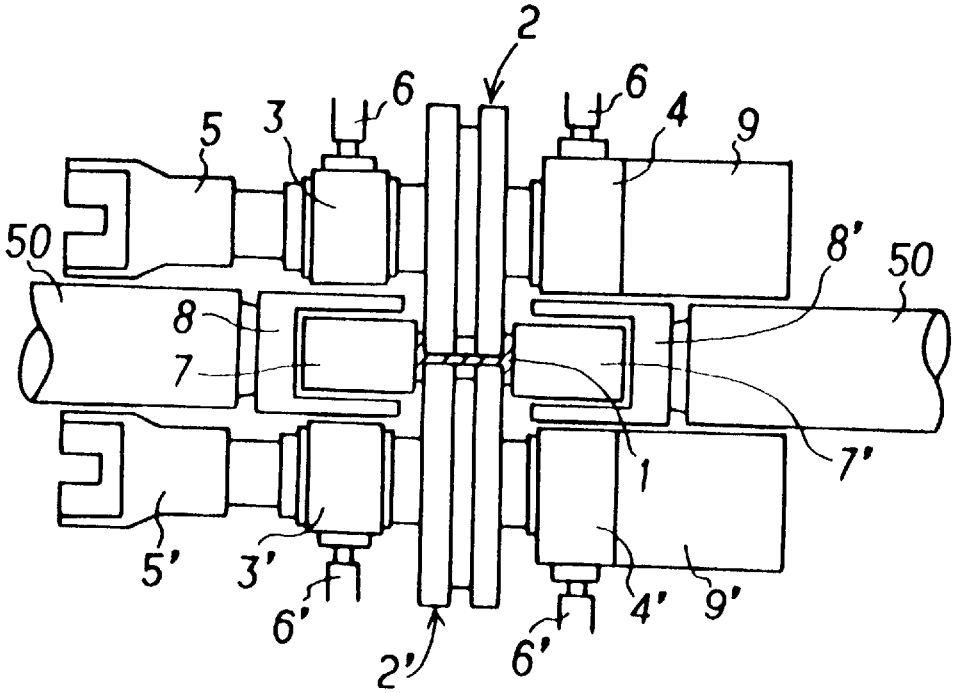
FIG. 6 is a front view of an essential portion of a universal rolling mill in which horizontal rolls have a variable width.
Figure 7:
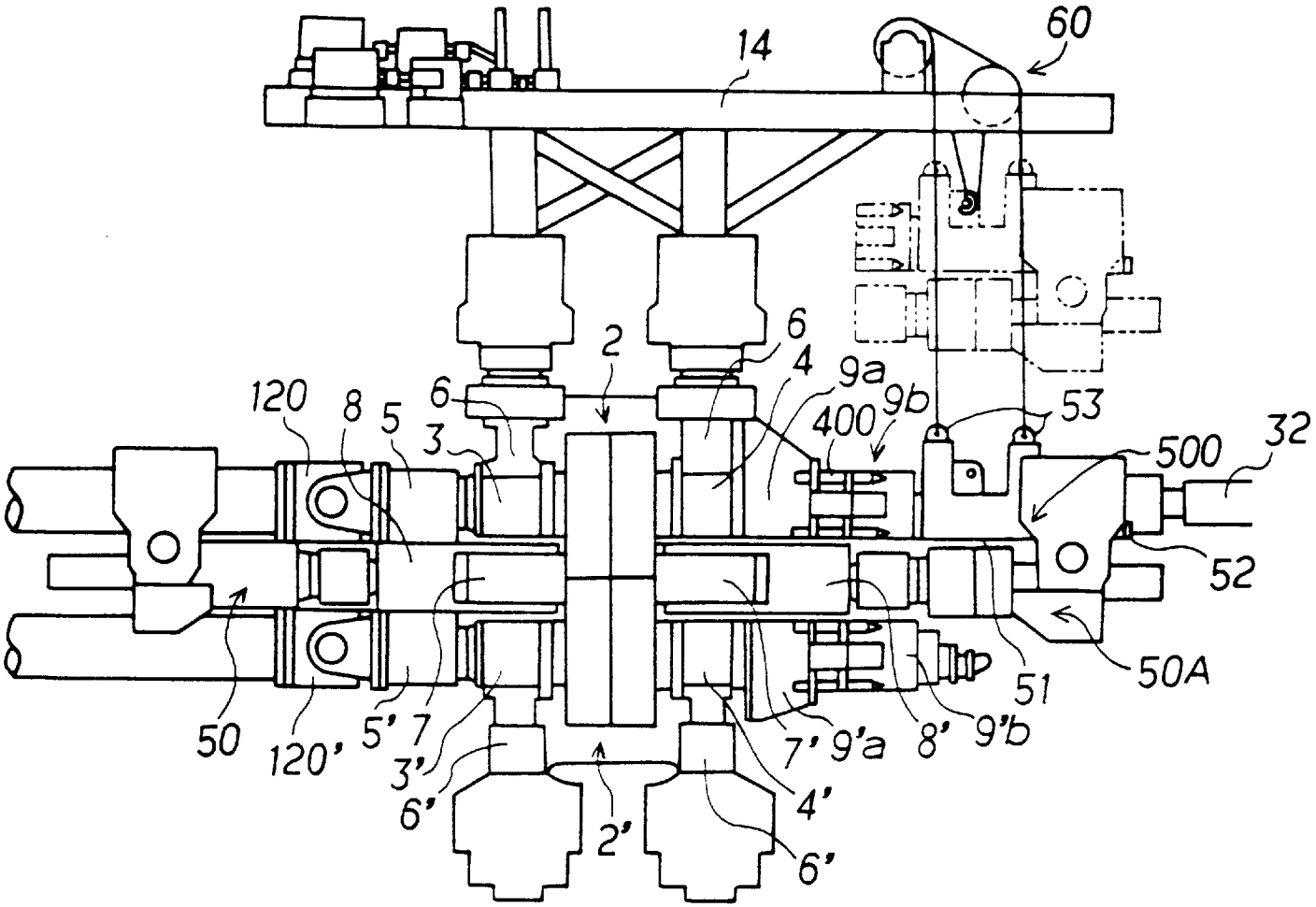
FIG. 7 is a front view of an essential portion of a universal rolling mill of an embodiment of the present invention.

FIG. 7 is a front view showing an embodiment of the invention. Rolling rolls are in rolls contact state.

In FIG. 7, a receiving/passing device 500 is mounted to a yoke 50A on the operating side. The receiving/passing device 500 has a guide 51 for guiding a support box 9*b* that houses the driving portion of an upper width-variable rolling roll 2 and a cylinder 52 for drawing the support box 9*b* into the guide 51 and for pushing the support box 9*b* out of the guide 51.

The support box 9*b* can be separated from the support box 9*a* at a joint face therebetween by releasing a lock device 400. The driving portion in the support box 9*b* can be separated from a roll shaft by operating an electric motor 32.

In FIG. 7, hangers 53 are provided to the guide 51. By pulling wires passed through the hangers 53 by using a hoisting device 60 disposed on an upper frame of a housing 14, it is possible to cause the support box 9*b* and the yoke 50A to recede at a time from an operating position (shown by a solid line) to a waiting position (shown by a chain double-dashed line) if the support box 9*b* has been drawn into the guide 51. After the receding of them, space can be kept for replacement of a roll set at a time.

Figure 8:
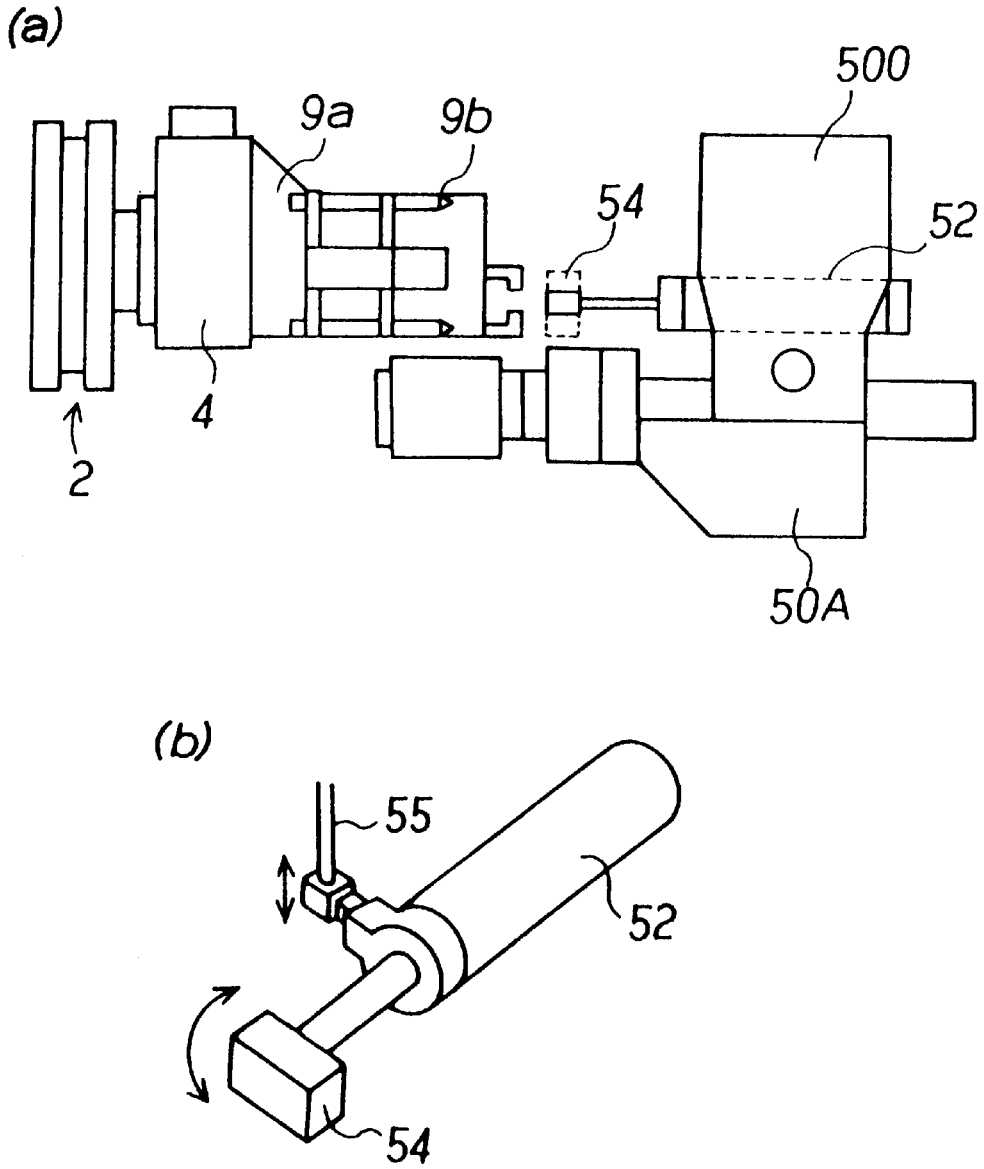
FIG. 8(*a*) is a front view showing an essential portion of a receiving/passing device and FIG. 8(*b*) is a partial 3-D view of the portion.

FIG. 8 shows an example of a mechanism for connecting and separating a support box 9*b* and a yoke 50A to and from each other. A chuck 54 that is caused to rotate by moving up and down of a bar 55 to be connected to and separated from the support box 9*b* is provided to a rod tip end of a cylinder 52. In order to draw the support box 9*b* from the rolling mill into the receiving/passing device, the chuck 54 is connected to the support box 9*b*. On the contrary, after the support box 9*b* is pushed from the receiving/passing device into the rolling mill, the chuck 54 is detached to release the support box 9*b*. The support box 9*b* is further joined to the support box 9*a* and can move freely with the rolling mill.

With the above device of the invention, an on-line roll replacing operation can be carried out easily. An example of the steps will be described below by referencing to the FIG. 7.

[Start]

1) Spindle couplings 5, 5' are released from spindles 120, 120'.

2) The electric motor 32 is operated to separate the driving portion in the upper support box 9*b* from the roll shaft (the lower driving portion remains connected).

3) The cylinder 52 is brought into a pushed state to connect the receiving/passing device 500 and the support box 9*b*.

4) The lock device 400 is released to separate the support box 9*b* from the support box 9*a* (the lower support box 9*b*' remains connected).

5) The cylinder 52 is brought into a drawn state to draw the support box 9*b* onto the guide 51.

6) The yoke 50A is lifted by the hoisting device 60 and moved to the waiting position (the support box 9*b* on the guide 51 is replaced by a new one if necessary).

7) [Replacement of rolls at a time] The roll set in the housing 14 is drawn out to the operating side and a new roll set is pushed into the housing 14. In the new roll set, the upper support box 9*b* is detached in advance.

8) The yoke 50A is moved down by the hoisting device 60 and moved to the operating position.

9) The cylinder 52 is brought into the pushed state to push the support box 9*b* into the rolling mill.

10) The electric motor 32 is operated to connect the driving portion in the upper support box 9*b* to the roll shaft. Before the connecting, small amount positioning is carried out.

11) By using the lock device 400, the support box 9*b* is joined to the support box 9*a*.

12) The cylinder 52 is brought into the drawn state to separate the support box 9*b* from the receiving/passing device.

13) The spindle couplings 5, 5' are connected to the spindles 120, 120'.

[End]

Possibilities of Industrial Applications

According to the invention, the rolls including the width-variable rolling rolls can be easily replaced at a time even in the universal rolling mill of a type in which the yoke is caused to recede upward and excellent effect of improving the productivity is exhibited.

What is claimed is:

1. A universal rolling mill comprising width-variable rolling rolls each having a driving portion detachably joined to an end portion of a roll shaft on an operating side for varying a rolling width, said width-variable rolling rolls being used as horizontal rolls, wherein a receiving/passing device for receiving and passing said driving portion of an upper width-variable rolling roll from and to said rolling mill is mounted to a yoke for receiving reaction force of an upright roll on said operating side.

2. A universal rolling mill according to claim 1, wherein said receiving/passing device has a guide for guiding a support box for housing said driving portion of said upper width-variable roll and a cylinder for drawing and pushing said support box into and out of said guide.

* * * * *